US005533767A

United States Patent [19]

Georgopoulos et al.

[11] Patent Number: 5,533,767

[45] Date of Patent: Jul. 9, 1996

[54] SEAL

[75] Inventors: George Georgopoulos, Pine Brook; George A. Lundberg, Jr., Kinnelon, both of N.J.

[73] Assignee: E. J. Brooks Company, Newark, N.J.

[21] Appl. No.: 357,873

[22] Filed: Dec. 16, 1994

Related U.S. Application Data

[63] Continuation-in-part of Ser. No. 72,501, Jun. 4, 1993, Pat. No. 5,441,316.

[51] Int. Cl.[6] ..... B65D 27/30

[52] U.S. Cl. ..... 292/320; 292/307 A; 292/325

[58] Field of Search ..... 292/307 R, 320, 292/317, 307 A, 321, 322, 319, 325; 24/16 PB

[56] References Cited

U.S. PATENT DOCUMENTS

| | | | |
|---|---|---|---|
| 3,591,223 | 7/1971 | Neto | 292/320 X |
| 4,106,802 | 8/1978 | Lozio | 292/320 |

FOREIGN PATENT DOCUMENTS

| | | | |
|---|---|---|---|
| 2164661 | 8/1973 | France . | |
| 8902405 | 5/1989 | Germany . | |
| 1594207 | 7/1981 | United Kingdom | 292/320 |
| 2126957 | 4/1984 | United Kingdom . | |
| 2163392 | 2/1986 | United Kingdom . | |
| 2168654 | 6/1986 | United Kingdom | 292/320 |

OTHER PUBLICATIONS

PCT Search Report, PCT/US94/03391, dated Sep. 21, 1994.

*Primary Examiner*—Rodney M. Lindsey
*Attorney, Agent, or Firm*—William Squire

[57] ABSTRACT

A molded one piece thermoplastic seal comprises a tab, a socket depending from the tab, a pair of links extending from the tab and a locking member secured to the other end of the links. A tether is secured at opposite ends to the locking member with one of the tether ends weakened. The locking member comprises a pair of resiliently secured tangs attached to a cross-member in which there are a pair of opposing grooves and a transverse hole for receiving the tether. The recesses and hole are inserted within the cavity of the socket with the tether free end inserted so as to lock the tether within the recesses and hole. The tether includes a plurality of projections, one projecting from the tether on each side of the locking member so that when the tether is locked to the locking member in the socket the tether cannot be removed. In a further embodiment, two locking members each having a pair of locking tangs are attached to a strap in tandem. The socket member includes a pair of uniquely identified socket cavities keyed so that only one cavity can receive the lead locking member. Unique indicia on the seal includes the identification of the keyed cavities to preclude tampering with a false reuse of the seal.

16 Claims, 5 Drawing Sheets

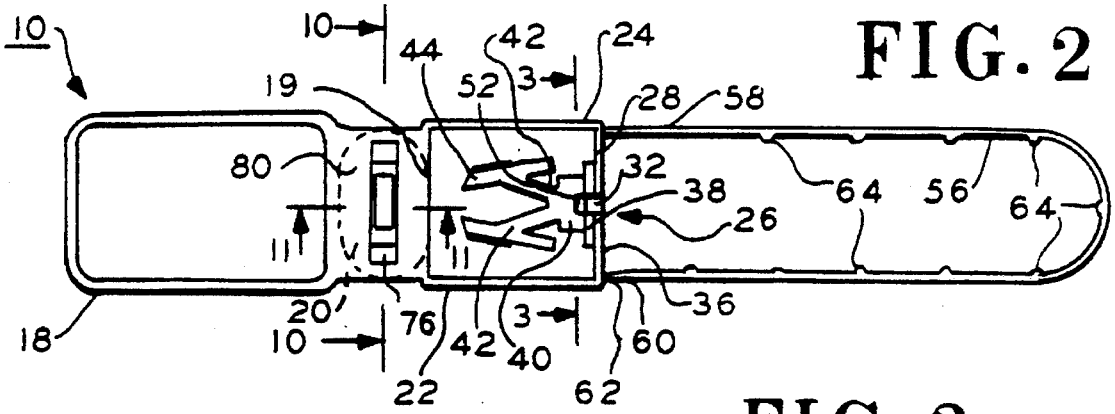
FIG. 2
FIG. 3
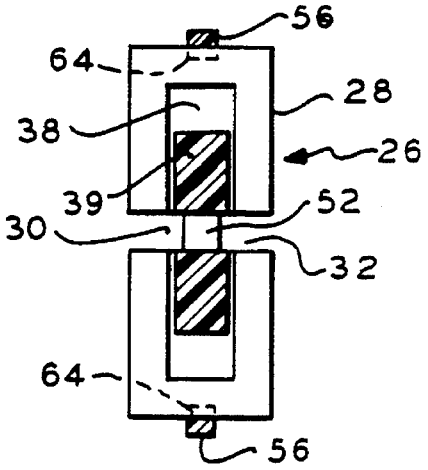
FIG. 3a
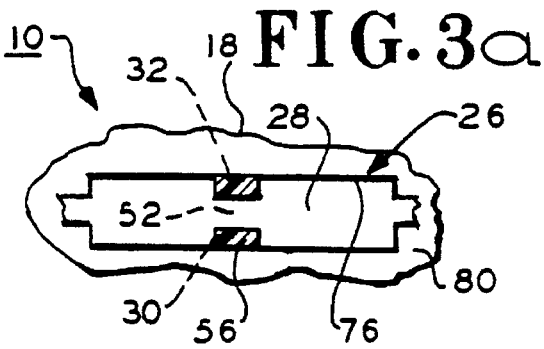
FIG. 4
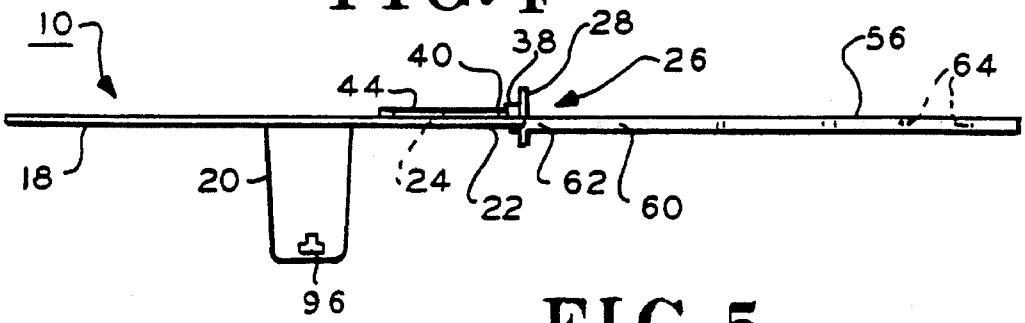
FIG. 5
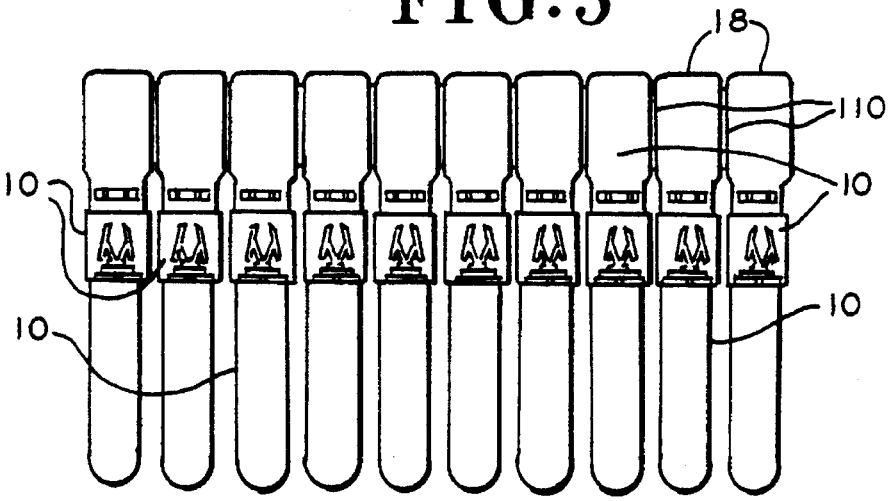

SEAL

This is a continuation-in-part application of application Ser. No. 08/072,501 filed Jun. 4, 1993 now U.S. Pat. No. 5,441,316.

This invention relates to seals and, more particularly, to thermoplastic seals including a locking tang at one end of a strap and a socket at the other end of the strap into which the tang is inserted and permanently locked.

Such seals, sometimes referred to as self-locking seals, typically comprise a body generally molded of thermoplastic. The body has a socket with a locking cavity. A strap is attached to the body and has at its free end a pair of resilient locking tangs. The tangs are compressed during insertion into the socket cavity due to interference fit. The tangs then expand after insertion into the socket cavity which is larger than the egress of the cavity. Once inside the cavity, the tangs engage locking shoulders precluding removal from the socket.

For example, in U.S. Pat. No. 3,367,701 such a seal is illustrated. Also as illustrated in this patent is an abutment which is located within the cavity for spreading the tangs apart so as to preclude reverse removal of the tangs once inserted and locked into the recess. Other self-locking security seals are disclosed in U.S. Pat. Nos. 4,106,801; 4,818,002; 4,175,782; 5,118,148; and 3,149,869. Several of the above patents disclose a set of tangs attached to one end of a strap and a body including a socket attached to another end of the strap, the entire arrangement being molded thermoplastic. The tang arrangement is inserted and locked to a cavity in the socket.

UK patent application 2 126 957 discloses a capsule having a socket and an insert to which a sealing filament is attached having a free end. The insert has grooves on opposite sides and a through aperture in communication with the grooves. The insert has locking tangs. The insert is inserted into the cavity of the socket with the filament free end in the grooves and passing through the aperture to lock the free end to the inserted insert. The filament free end is intended to be locked to the inserted insert by this arrangement. French patent 2.164.661 discloses a similar arrangement. However, the present inventors recognize that the free end can be manipulated free of the locked insert to defeat the seal.

British patent application 2 163 392 discloses a tandem arrangement of locking barbs which mate in a locking cavity in tandem order to provide double locking action. British patent 1 594 207 discloses a seal comprising a main tubular member with an entrance and exit aperture. A spigot comprises a tandem arrangement of barbed sections which are inserted into the tubular member. The barbs are trapped behind a sleeve at the entrance aperture. A slot is in the member for observing the inserted spigot. The seal can be resealed by withdrawing the spigot end from the exit aperture and inserting the nose of the next barb assembly into the entrance until trapped.

German Gebrauchsmuster 89 02 405.2 shows another seal arrangement in which a locking strap is inserted into a socket which has a smaller length than the male locking portion on the free end of the strap.

The present inventors recognize a need for an approved seal employing a locking arrangement such as disclosed in certain of the aforementioned patents. One problem recognized is that it is desirable to provide tamper evidence when a lock has been broken into and the seal has been somewhat reassembled to hide the fact that the seal has been broken into. For example, in all of the seals disclosed above if a strap portion is broken and the tangs removed, it would be difficult to visually identify that the tangs are still locked in place in the arrangement if the strap is reinserted into the socket and glued in place with or without the tangs reattached to fool an observer. A second problem is that in many cases the seals are employed in the transportation industry where the seals are used to lock doors of trucks and the like using the hasps of the truck doors holding the cargo. The driver of the truck needs to carry extra seals so that on the return trip the driver can reseal the truck doors after the truck has been unloaded and reloaded at a first destination. The present inventors recognize the desirability of reducing the number of extra seals that a driver has to carry in order to provide a locking seal for the driver after a seal has been used and broken open to permit unloading of cargo and, thus, requiring a second new seal for resealing any cargo.

A need is seen for providing a seal which comprises an integral structure so that all of the components are joined and can not be lost with respect to one another during use. Another problem recognized with prior art seals is tampering. It is desirable to provide a pick-proof seal. The present inventors recognize that a pick which can be inserted in the socket may be utilized to flex the mating locking tang to remove it.

A seal construction according to the present invention comprises a socket member having first and second cavities each having at least one locking recess, each cavity having a separate corresponding locking device receiving opening in the socket member. A locking device is included and includes first and second locking members, each locking member for insertion through an opening into a cavity for locking that locking member to the socket member in that cavity. Strap means couple the locking device to the socket member for locking an article to the strap means when the locking device is locked to the socket member.

In a further embodiment, the locking members are secured to the strap means in tandem.

In a further embodiment, the first locking member is secured to the second locking member, the second locking member being secured to the strap means, the first and second openings and first locking member being keyed such that only one of the openings can receive the first locking member, the other opening for receiving the second locking member.

In this way, the seal comprises two independent locking members and mating locking sockets so that the single seal construction can be used several times.

In a further embodiment, the keyed sockets are identified with unique numbers and each seal is provided with a unique number that includes the socket number to preclude tampering with the two use seal.

IN THE DRAWING

FIG. 1*a* is an isometric view of a seal in accordance with one embodiment of the present invention;

FIG. 1*b* is a side elevation view of the embodiment of FIG. 1*a;*

FIG. 2 is a plan view of the as molded seal of the embodiments of FIGS. 1*a* and 1*b* prior to use in a locking configuration;

FIG. 3 is a sectional elevation view taken along lines of 3—3 of FIG. 2;

Figure 1A:
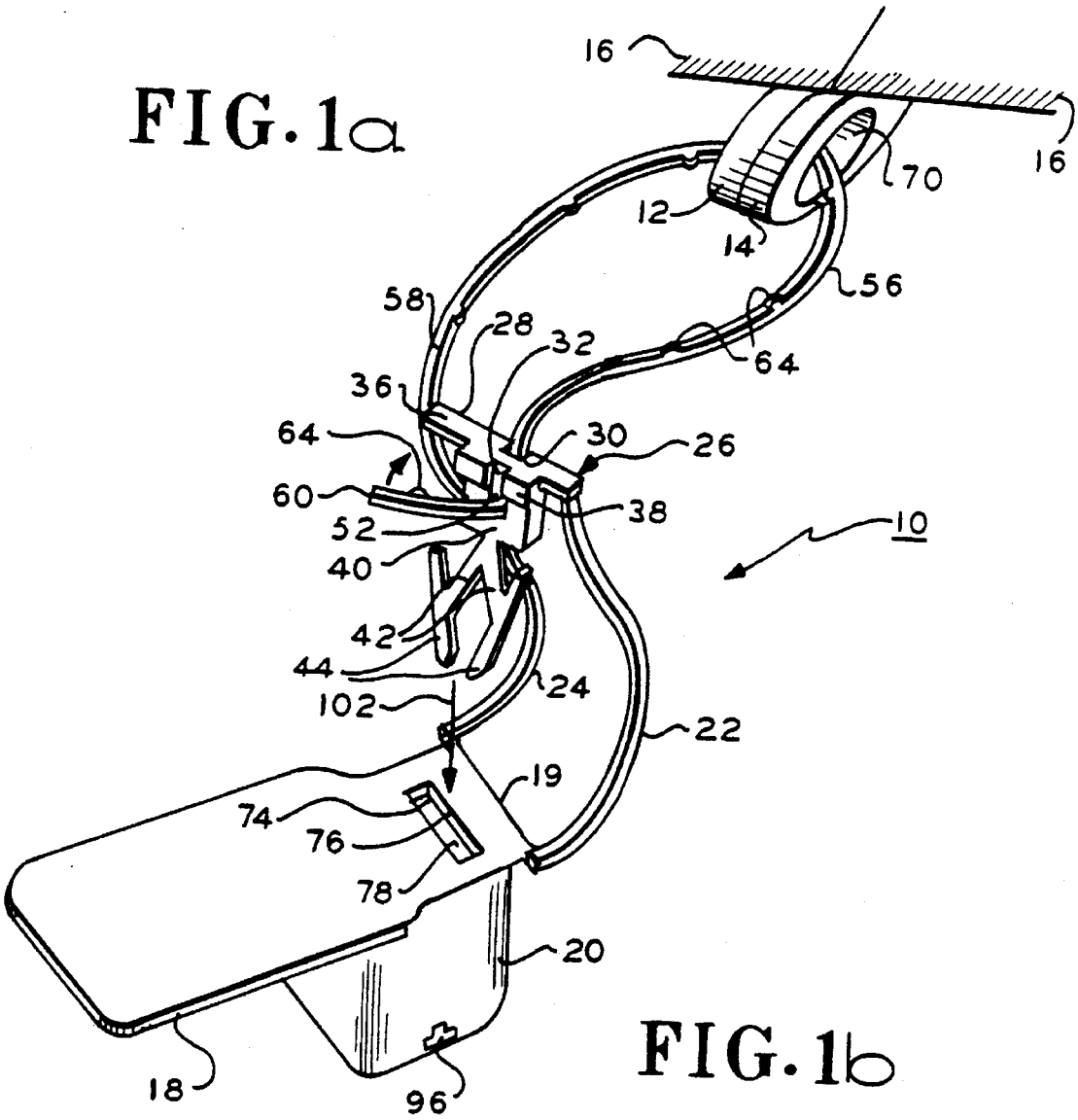
Figure 1B:
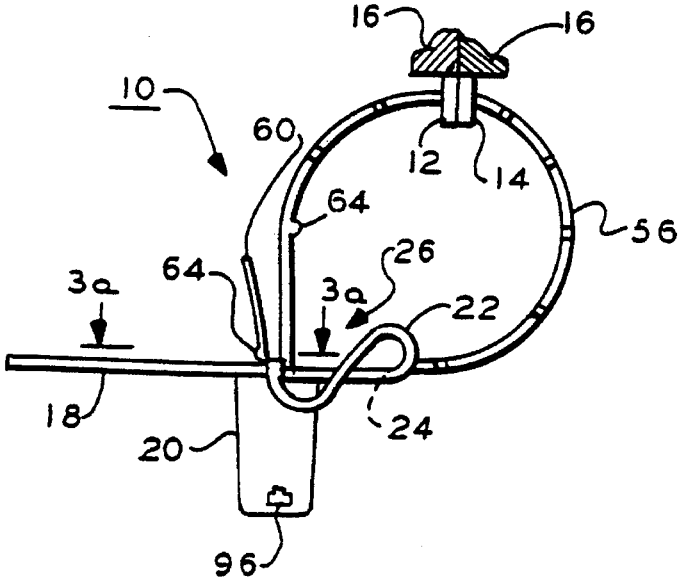

FIG. 3*a* is a sectional plan view taken along lines 3*a*—3*a* of FIG. 1*b;*

Figure 6:
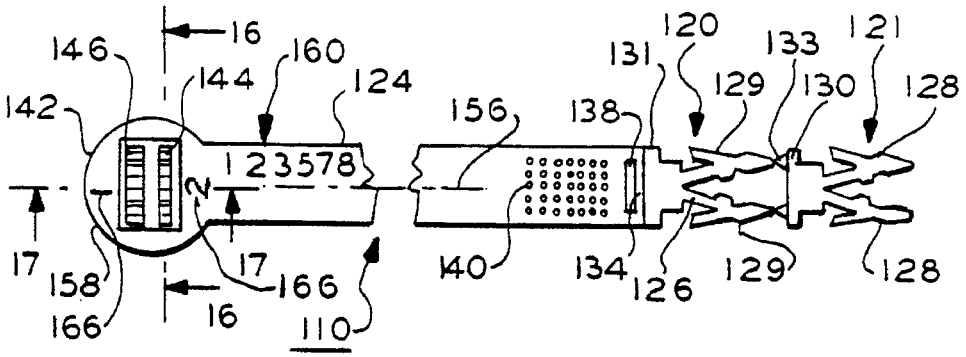
Figure 7:
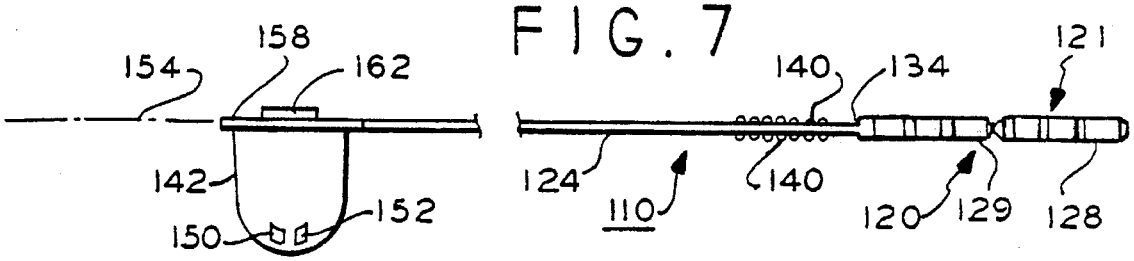
Figure 8:
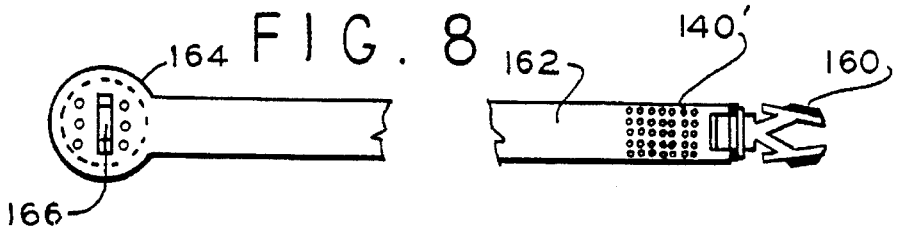
Figure 9:
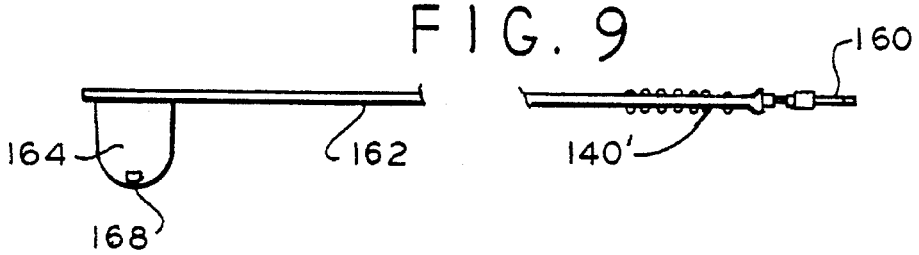
Figure 10:
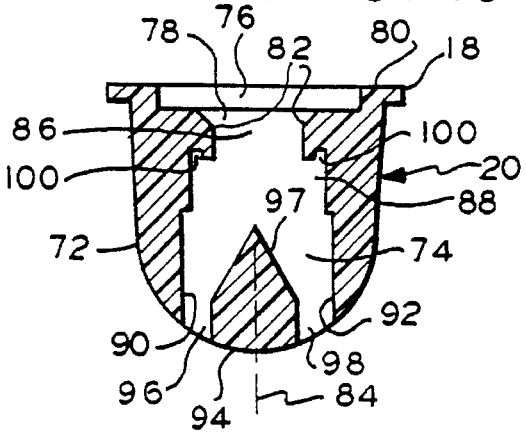
Figure 11:
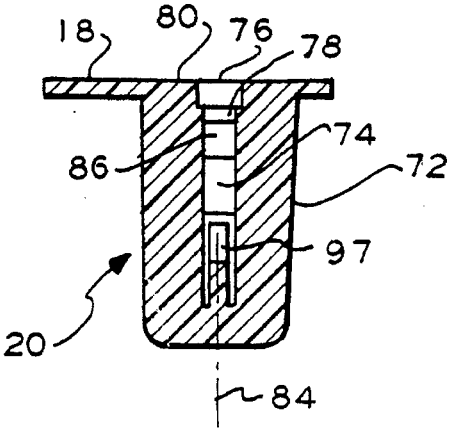
Figure 12:
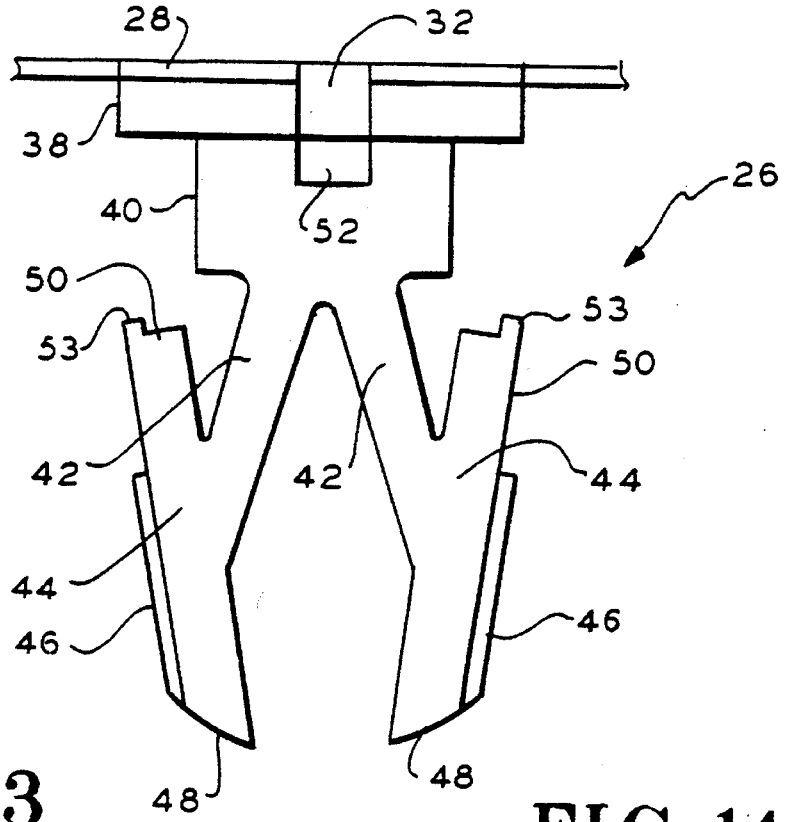
Figure 13:
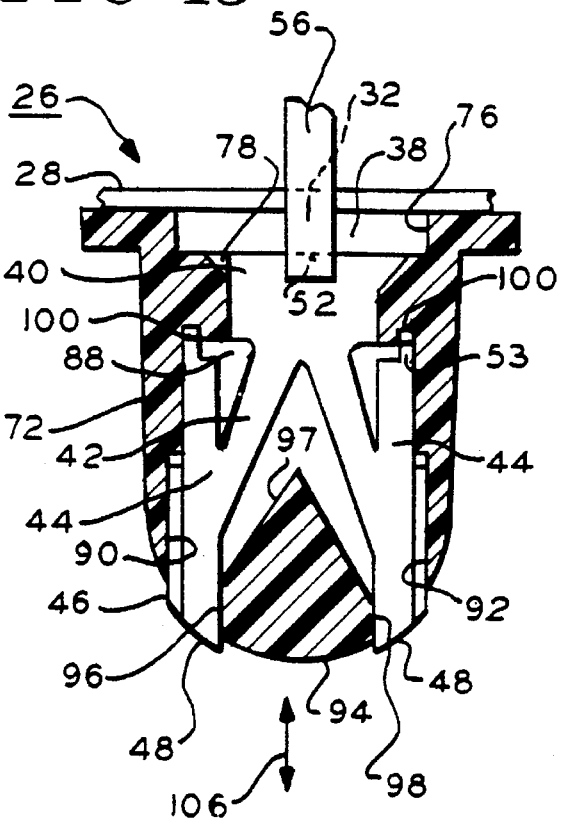
Figure 14:
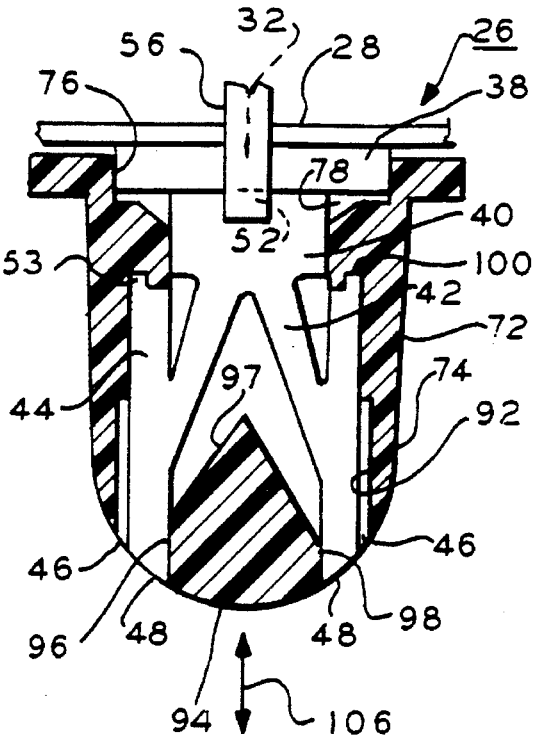
Figure 15:
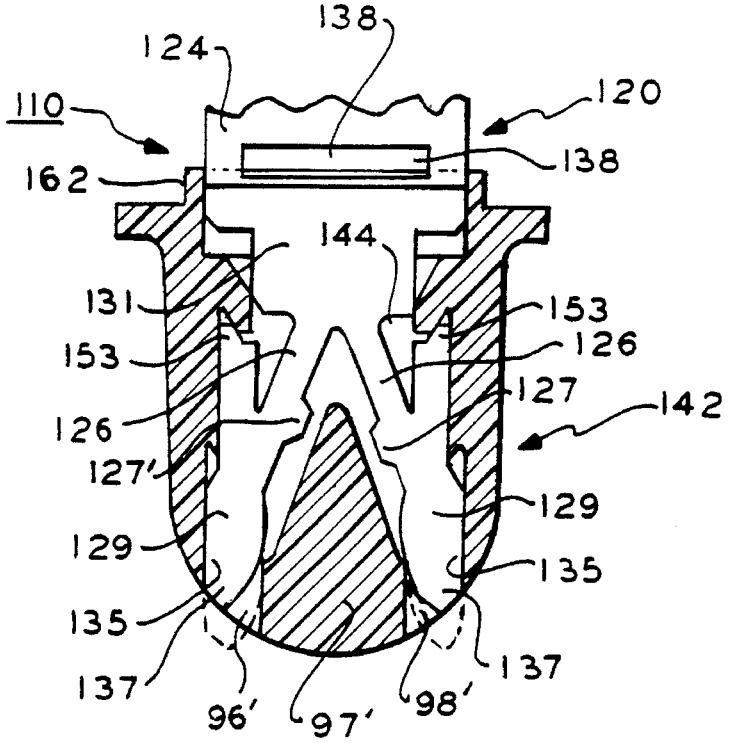
Figure 16:
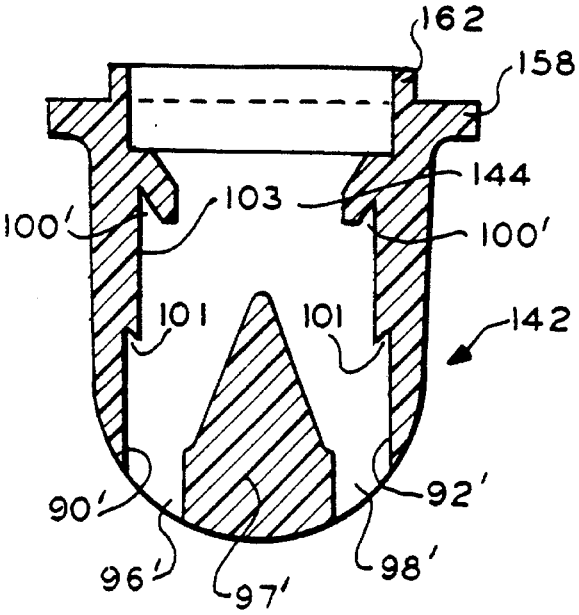
Figure 17:
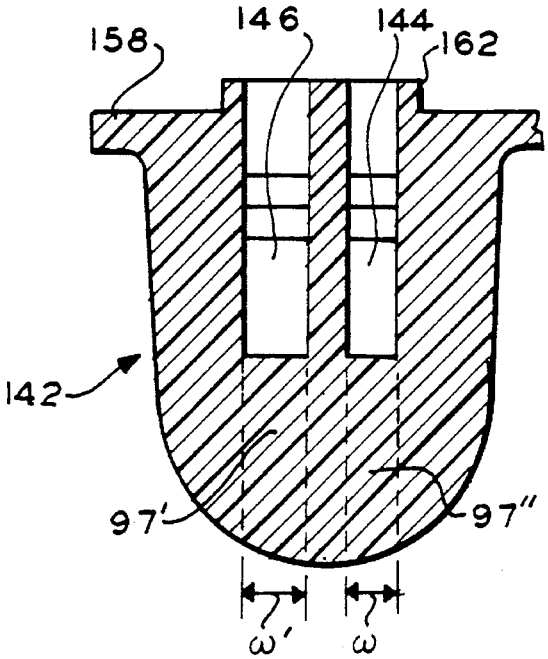

FIG. 4 is a side elevation view of the embodiment of FIG. 2;

FIG. 5 is a plan view of the embodiment of FIG. 2 in which the embodiment is molded in multiple sets;

FIG. 6 is a fragmented plan view of a seal according to a second embodiment of the present invention;

FIG. 7 is a side elevation view of the embodiment of FIG. 6;

FIG. 8 is a plan fragmented view of a seal according to a third embodiment of the present invention;

FIG. 9 is a side elevation view of the embodiment of FIG. 8;

FIGS. 10 and 11 are sectional elevation views of the embodiment of FIG. 2 taken along respective lines 10—10 and 11—11;

FIG. 12 is an enlarged more detailed elevation view of the tang portion of the seal of the embodiments of FIGS. 1*a* and 8;

FIGS. 13 and 14 are respective sectional elevation views similar to the view of FIG. 10 of the embodiments of FIGS. 1*a* and 8 to illustrate different relative locked positions of locked tangs;

FIG. 15 is a sectional elevation view of the locked state of the embodiment of FIGS. 6 and 7; and FIGS. 16 AND 17 are elevation sectional views of the embodiment of FIG. 6 taken along respective lines 16—16 and 17—17 similar to the views of respective FIGS. 10 and 11.

In FIGS. 1*a* and 1*b*, seal 10 is shown locking two hasps 12 and 14 secured to a support 16 such as corresponding doors or panels to be secured. The seal 10 comprises a planar tab 18 from which depends a socket 20. A pair of flexible links 22 and 24 have one end attached to tab 18. The links 22 and 24 are spaced from each other on opposite sides of the tab 18 at end 19.

A locking member 26 is secured to the other ends of links 22 and 24. Preferably the links 22, 24 and locking member 26 including tab 18 and socket 20 are all molded thermoplastic material formed as a single integral unit as illustrated in FIGS. 2 and 4.

In FIG. 2, the locking member 26 comprises a cross member 28, rectangular in cross-section, secured at its opposing ends to a different one of the ends of links 22 and 24 distal tab 18 end 19. The cross member 28 includes a rectangular projection 38. The cross member has a pair of like grooves 30 and 32, rectangular in cross-section, on opposite sides of the cross member 28 and projection 38 extending in a direction parallel to links 22 and 24. The grooves 30 and 32 are perpendicular to planar end surface 36 of cross member 28. A rectangular in cross-section projection 40 depends from and converges toward rectangular projection 38.

A rectangular in cross-section hole 52, FIG. 12, in projection 40 is in communication with each of the grooves 30 and 32. The hole 52 is formed in the projection 40 next adjacent to grooves 30 and 32 as best seen in FIG. 3. The projections 38 and 40 and member 28 form a somewhat stepped arrangement as seen in FIG. 2. The hole 52 provides communication between the grooves 30 and 32 on each side of member 28.

The locking member 26 includes a V-shaped member comprising legs 42 depending from projection 40. As shown in more detail in FIG. 12, a pair of tangs 44 according to a first embodiment each depend from the extended end of a different one of the legs 42. The tangs 44 are identical and are attached to the legs 42 in mirror image fashion. Each tang 44 comprises an elongated rectangular in section member which is attached somewhat centrally to an end of a leg 42. The tangs 44 are inclined and converge toward one another at their tips 48. A rectangular in section rib 46 projects lengthwise along the outer side length of each tang 44 from a surface thereof opposite the member 42. The rib 46 extends from the member 44 tip 48 upward to about a mid-section of the corresponding tang 44. The tip 48 is curved to form a continuous surface with the socket 20 bottom surface 94, FIG. 14. The tail portion 50 of each tang 44 includes a rearwardly extending projection 53. The rib 46 may be somewhat thinner in a direction into the drawing of FIG. 12 than the tang 44. A rib 46 and projection 53 are on each of the tangs 44.

A tether 56, rectangular in cross-section of about the same dimensions as grooves 30 and 32, is secured at one of its ends 58 to member 28 adjacent to an end of link 24 and at its other end 60 to member 28 adjacent to an end of link 22. The end 60 includes a reduced section 62 which weakens the tether 56 so that the tether 56 may be manually, separated from member 28 at end 60. The tether 56 may be circular in cross-section or other shapes. The tether 56 thus forms a loop as attached to the locking member 28 and is secured to the member 28 only at the tether ends 58 and 60. The end 58 is secured permanently to the member 28 whereas the other end 60 is sufficiently weakened so as to be manually removed upon the finger pressure from the member 28.

The tether 56 includes a plurality of spaced projections 64. The tether 56 has a transverse cross-section area including the projections 64 about the same as the cross-section area of hole 52 so that the tether 56 and projections 64 can pass through the hole 52 from groove 30 to groove 32 or vice versa. However, the grooves 30 and 32 each have a cross-sectional area the same as the tether body so that the tether main body portion, excluding the projection 64, can closely be received therein.

The cross-section area of the tether through the projections 64 are each sufficiently large relative to the cross-section area of the grooves 30 and 32 such that the projections 64 protrude beyond the grooves 30 or 32, FIG. 3*a*. As a result, the tether 56 may slide axially via the grooves 30, 32 and hole 52 until that position of the tether where a projection 64 abuts one of the grooves 30 and 32. At this location, the tether can no longer pass through the grooves 30 and 32 when the member 28 is inserted and locked in the cavity of socket 20 (to be described below) in the position of FIG. 3*a*. The socket 20 forms a fourth side wall of the channel formed by grooves 30 and 32 forming a hole which is too small to pass tether 56 and a projection 64 therethrough.

In FIG. 1*a*, end 60 has been separated from the member 28 and passed through holes 70 of hasps 12 and 14. The free end 60 of the severed tether 56 is inserted in groove 30, passed through hole 52 and aligned in grooves 30 and 32. The tether 56 is pulled through the hole 50 an amount sufficient to insure that at least one of the projections 64 is on each side of the hole 52 beyond grooves 30 and 32.

In FIGS. 10 and 11 representative socket 20 comprises a thermoplastic molded body 72 which is integral with the tab 18, and has a cavity 74. The cavity 74 has an opening 76 comprising an enlarged egress relative to a smaller tapered egress opening 78, the opening 76 being next adjacent to the external surface 80 of the socket body 72. The opening 76 accommodates the projection 38. A pair of inwardly inclined mirror image projections 82 form the transverse dimension of the opening 78. The projections 82 have inclined upper shoulders and are spaced apart an amount sufficient so as to squeeze the tangs 44, FIG. 12, together during insertion.

The tangs 44 are oriented somewhat vertically parallel to axis 84 in the direction of insertion of the tangs and locking member 26 along axis 84. The projections 82 form a relatively narrow neck 86 just following the egress opening 78. The neck 86 closely accommodates projection 40. The cavity 74 widens into region 88 for accommodating the tangs 44 in the orientation of FIGS. 13 and 14.

The cavity 74, FIG. 10, has a pair of channels or recesses 90 and 92. The recesses 90 and 92 are each dimensioned to respectively receive a corresponding rib 46 of the tangs 44, FIG. 12. Cavity 74 is in communication with the ambient atmosphere at the bottom 94 of socket 20 via openings 96 and 98. The openings 96 and 98 are dimensioned to closely receive the tips 48 of the tangs, FIGS. 13 and 14. A further recess 100 is at the end of each recess 92 on each side of the cavity 74 opposite openings 96 and 98. The recesses 100 closely receive the projections 53 of the locked tangs 44, FIG. 12. A central tapered wedge hub 97 wedges the tangs 44 into recesses 90 and 92 during and after insertion.

The central tapered wedge hub 97 spreads the tips 48 of the tangs 44 apart and causes them to enter into the openings 96 and 98. The wedge hub 97 forces the tangs 44 and the mating ribs 46 into the corresponding recesses 90 and 92 to insure positive locking of the tangs in the cavity 74. Further, the locking projections 53 at the tail end of the tangs 44 are forced into recesses 100, locking the tangs in place and provide further tamper resistance to the removal of the locking member.

In operation, tether 56 is separated at end 60 at weakened portion 62 and inserted through the hole 70 of hasps 12 and 14 FIG. 1*a*. The free end 60 of the tether is then attached to grooves 30 and 32 via hole 52 as seen in FIGS. 1*a*, 1*b*, 13 and 14. At least one of the projections 64 is also passed through the hole 52. In this way, at least one projection 64 is on each side of the member 28 extending beyond a groove 30 and 32. With the tether positioned in the grooves 30 and 32 and hole 52, the locking member 26 is then inserted into cavity 74 via openings 76 and 78 in direction 102, FIG. 1*a*. In this position, the tether cannot be removed from the hole 52 and grooves 30 and 32 due to the projections 64.

When the tangs 44 are fully inserted in cavity 74, the projections 53 thereof engage and lock in recesses 100, the ribs 46 engage and lock in recesses 90 and 92 and the locking member 26 is locked in place. With the locking member 26 so locked, the locking member 26 may be displaced in directions 106, FIGS. 13 and 14, without disengaging the locked state of the locking member 26 in the cavity 74. By so displacing the locking member 26, the tips 48 of the tangs 44 can be readily observed to be attached to the tether 56.

Any tampering which severs the tangs from the tether with the tether glued in place would result in the tangs not displacing. The displaceable projection of the tips 48 out of the openings 96 and 98 at the bottom of the cavity 74 therefore provides visual evidence of tampering.

If desired, the links 22 and 24 may be severed from member 26. The assembly, FIGS. 2 and 4, is flat and provides a seal for threading through relatively small apertures regardless the larger size of the socket 20 and locking member 26.

In FIG. 5, a plurality of seals 10 are shown molded in an array in which the tabs 18 are molded with a weakened seam 110 between each of the adjacent tabs. The weakened seams 110 can be easily manually severed by hand and the separate seals 10 can then be utilized individually.

FIGS. 6, 7 and 15–17 illustrate a seal 110 in an alternative embodiment in which tang devices 120 and 121, strap 124 and socket 142 are different than that of the seal 10, FIG. 1*a*. In FIGS. 6 and 7, socket 142 is connected to tandemly connected tang devices 120, 121 by a flexible, rectangular in section, strap 124 which has a weakening aperture 138 adjacent to the device 120.

Tang device 120 includes a T-shaped, planar rectangular in section, support 131 extending from strap 124 and from which resilient tangs 129 extend. Tangs 129 lie in the plane of the strap 124 and support 131. Support 131 and tangs 129, which are the same thickness, FIG. 7, are thicker than strap 124, but of the same width, forming a shoulder 134 on each side. A pair of V-oriented legs 126 extend from support 131. Tangs 129 are secured at their midsection to the ends of the legs 126. An inwardly directed trapezoidal projection 127 projects from a corresponding leg 126 adjacent to a tang 129, FIG. 15. A second inwardly extending projection 127' projects from the other leg 126.

Each tang 129 has an outwardly extending coplanar rib 135 of the same thickness extending from the tang tip 137 to approximately the tang medial region. The rearmost portion of each tang 129 has a rearwardly extending tapered projection 153.

In FIG. 6, the device 121 is of the same shape as device 120, but is thicker as shown in FIG. 7. The device 121 is coplanar with the device 120 and is symmetrical with device 120 about longitudinal axes 154 and 156. The device 121 tangs 128 and corresponding legs extend from support 130. The devices 120 and 121 have the same dimensions in plan view, FIG. 6.

The tips of tangs 129 of device 120 are connected to the support 130 of device 121 by relatively weak tapered portions 133. Portions 133 permit the device 121 to be selectively detached from device 120.

Strap 124 is significantly larger than the tether 56 of the embodiment of FIG. 1*a*. A plurality of bumps 140 are formed on strap 124 to permit manual gripping for insertion of the tang devices 120 and 121 into the mating sockets to be described.

Socket 142 depends from circular flange 158 at the other end of the strap 124. The socket 142 has two spaced locking cavities 144 and 146. The cavities 144 and 146 are identical in the view of FIG. 16, but have different respective transverse widths w and w', FIG. 17. The width w of cavity 144 is such as to receive only the thinner tang device 120 and preclude insertion of thicker tang device 121. The endmost thicker tang device 121, FIGS. 6 and 7, can only be received in the wider cavity 146. The cavity 146 is identified with a corresponding identification indicia (ID) 166, e.g., number "1", FIG. 6, and the cavity 144 is identified with a corresponding ID number "2" molded or stamped onto the surface of the flange 158.

Because of the different thicknesses, the tang device 121 must, during use, be inserted only in cavity 146, identified as number 1, to lock the seal in the initial locking mode. When it is desired to reuse the seal 110 a second time, the device 121 is severed from device 120 at weak tapered portions 133. This exposes the inner device 120 for insertion in the second remaining cavity 144 identified with number 2. The device 121 remains locked inside cavity 146.

The purpose of the above action in using specific corresponding numbered cavities for each device 120 and 121 is to preclude further tampering. If for example the device 121 could be inserted in either locking cavity, then a user could reuse the seal without control by the owner of the goods being sealed. The user could state that the seal was previously used and the owner has no control over the truth of such a statement. In use, with the seal of the present invention, however, the owner can identify the seal with a unique number that includes the cavity number.

In use, each seal is identified with a unique serial number 160 which may be hot stamped on the strap 124, FIG. 6, for example. The cavity numbers 1 and 2 form the last digit of that unique serial number for a given use. Assume that the seal 110, Fig. is being used for the first time and that its unique number 160 on the strap is 123578. The seal for its initial use would then be identified as serial number 1235781, the last digit corresponding to the first cavity being used. When the seal is then reused, the last digit of its serial number would then be replaced by the digit "2" manifesting the seal is being reused. Therefore, the use of the first device 121 or second device 120 can be placed under central control at all times.

The tang devices 120 and 121 and the cavities 144 thus are dimensioned via their thicknesses to form a keying arrangement so that the lead tang device 121 must be inserted into cavity 146. However, it should be appreciated that other keying arrangements may be provided the lead tang device 121 such as a projection (not shown) having a mating groove (not shown) in the cavity 146, a longer length transverse the thickness than that of the other device 120 or a different peripheral shape, such as a shape that has different peripheral dimensions than that of the other device and so on. The different thicknesses is preferred.

Also, the tang devices 121 and 120 need not be in tandem as shown but may be in side by side relation. In this latter configuration, each tang device must be keyed to mate only in its corresponding cavity. In the embodiment of FIG. 6 the device 120 may fit into both socket cavities 144 or 146. But since the lead device 121 must be inserted in cavity 146 only, in practice, the device 120 can not be inserted in cavity 146 because device 121 is locked therein first and severed in place.

The locking cavities 144 and 146 may be identical to the cavity 74 of FIGS. 10, 11, 13 and 14. The cavities 144 and 146 are configured to receive and lock the tangs 128 and 129 as shown in FIG. 15. The cavities 144 and 146 may differ from cavity 74 by making recesses 100' corresponding to recesses 100, FIG. 10, tapered as shown to mate with the corresponding tapered projection 153 on the rear of the tangs 128 and 129, FIG. 15, to enhance the antipicking locking of the projection 153. That is, the tapered arrangement wedges the projection 153 in recesses 100' to preclude picking by forcing the projections radially inwardly toward each other. The pick will become wedged in the recesses 100' and be unable to force the projections out of the recesses 100'.

Further, an anti-picking tapered recess 101 is provided between rib 135 receiving recess 90' and the upper portion 103 of the side of cavity 146. A picking wire or tool inserted in opening 96' in the bottom of the socket 142 would engage recess 101 which precludes urging the tang 129, FIG. 15, radially inwardly to disengage projection 153 from recess 100'.

A central V-shaped hub 97' in cavity 146 and hub 197" in cavity 144 of the same shape as hub 97' precludes the transverse inwardly displacement of the respective tangs 128 or 129 by a picking tool inserted in openings 96', 98' in the socket bottom. The projections 127 and 127' on the tangs, FIG. 15, engage the hub 97' or hub 97" precluding forcing the tangs 129 or 128 transversely inwardly toward one another toward the hub in an attempt to free the devices 120 and 121 from locking engagement.

In FIGS. 7 and 16 the socket 142 has a boss 162 upstanding from flange 158 of the socket 142. The boss provides additional depth to the cavity 146 portion 164 receiving the support 130 of device 121.

In operation of the embodiment of FIGS. 6 and 7, the tangs 128 of device 121 are inserted in the socket 146, designated number 1, to provide a permanent seal. When it is desired to break the seal, the tang device 121 is severed at the tips of the tangs of device 120 at tapered portions 133. The tangs 128 remain locked in the socket 144.

When it is desired to use the seal of FIG. 6 a second time, the tangs 129 of device 120 are inserted into the second socket 144, designated number 2, to form a second permanent seal. In this way, one seal device can provide a dual seal for permitting a user to use the seal several times. At the same time control over the reuse of the seal is maintained.

While two tandem tang devices and two respective side by side mating locking socket cavities are illustrated in the embodiment of FIGS. 6 and 7, it should be appreciated that more than two tandem tang devices and mating number of socket cavities may be employed in a given seal to perform more than two sealing actions, for example three or more. This is in accordance with a given implementation. In the embodiment of FIGS. 6 and 7, each of the cavities of the sockets 144 and 146 have bottom openings 150 and 152 for receiving the tips of the tangs of the mating tang arrangement.

In FIGS. 8 and 9, a third embodiment is illustrated employing a tang arrangement 160 which is identical to that of the embodiment of FIG. 1. In the alternative, the arrangement could be identical to that shown in FIGS. 15 and 16. The tang arrangement 160 is attached to a strap 162 which may be identical to the strap 124 of the embodiment of FIG. 6. A socket 164 is attached to the other end of strap 162 without using a tab,such as tab 18, FIG. 1*a*. The socket 164 has a locking member receiving cavity 166 identical to the arrangement of the cavity 74, FIGS. 13 and 14. A pair of bottom openings 168, only one being shown in FIG. 9, is at the base of the socket 164 for receiving the tips of the tang arrangement 160. The bumps 140' on the strap 162 adjacent to the tang arrangement 160 enable firm grasping of the tang arrangement 160 during insertion into the socket 164.

It should be appreciated that modifications and variations to the various embodiments described herein may be made by one of ordinary skill in the art. It is intended that the scope of the present invention is as defined in the appended claims and not by the specific disclosed embodiments.

What is claimed is:

1. A seal construction comprising:

a socket member having first and second cavities each having at least one locking recess, each cavity having a separate corresponding locking device receiving opening in the socket member;

a locking device including first and second locking members, each locking member for insertion through an opening into the corresponding cavity for locking that locking member to said socket member in that cavity; and strap means coupling the locking device to the socket member for locking an article to said strap means when said locking device is locked to said socket member.

2. The seal construction of claim 1 wherein the locking members are secured to the strap means in tandem.

3. The seal construction of claim 2 wherein the first locking member is secured to the second locking member, the second locking member being secured to the strap means, the first and second openings and first locking member being keyed such that only one of said openings can receive said first locking member, the other opening for receiving the second locking member.

4. The seal construction of claim 3 including first reference indicia on said socket for identifying each cavity with a different reference indicia.

5. The seal construction of claim 4 including a unique second identifying reference indicia on one of said strap means and socket, said first and second indicia being combinable to form a third unique reference indicia.

6. The seal construction of claim 1 wherein the strap means comprises a strap secured at one end to said first locking member and the other end being secured to the socket member, the second locking member being secured to the first locking member, the locking device including weakening means for permitting selective separation of the second locking member from the first locking member and the first locking member from said strap.

7. The seal construction of claim 1 wherein said locking members each include a locking tang, the socket member cavities each having an aperture in communication with that cavity and the ambient atmosphere, said tang including a tip portion, said at least one locking recess being dimensioned relative to said tang for permitting said tang to displace in that locking recess and said tip portion to selectively protrude from that locking recess through said aperture while the tang is locked.

8. The seal construction of claim 1 wherein the first and second locking members each extend in a given direction for insertion into a corresponding cavity, said first locking member being dimensioned transverse the given direction relative to said openings such that the first locking member can only be inserted into the first cavity.

9. The seal construction of claim 8 wherein the locking members are secured to each other in tandem with the first member extending from the second member and the second member extending from the strap means.

10. A seal construction comprising:

a socket member having first and second cavities each having at least one locking recess, each cavity having a separate different corresponding locking device receiving configuration;

a locking device including first and second locking members each for locking to a locking recess, one of said locking members having a configuration corresponding to one of said cavities for insertion only into that one cavity for locking said one locking member to said socket member in that one cavity; and strap means coupling the locking device to the socket member for locking an article to said strap means when said locking device is locked to said socket member.

11. The seal of claim 10 wherein the locking members are arranged relative to said cavities such that only one locking member can be locked to the socket at one time.

12. The seal of claim 11 wherein the cavities each have a transverse width, the first and second locking members being connected to one another in tandem to the strap means with one locking member forming a free end, the one free end locking member having a thickness relative to the widths of said cavities and the other member such that the one free end member can only be inserted into the one cavity.

13. The seal construction of claim 10 wherein said at least one locking recess has a first channel for receiving a corresponding locking member in a locking direction and a second channel in communication with the first channel, said received corresponding locking member including a rib upstanding therefrom adapted to engage said second channel in the locked state when the corresponding locking member is inserted into the first channel.

14. The seal construction of claim 10 wherein said locking members each include at least one tang, said at least one locking recess comprises a first channel for receiving said at least one tang in a locking direction and a second channel in communication with the first channel, said at least one tang including a rib upstanding therefrom adapted to engage said second channel in the locked state when the at least one tang is inserted into the first channel in a locking direction.

15. The seal construction of claim 14 including a projection on said at least one tang and a tapered hub in said cavity for engaging the projection to resist deflection of the tang toward the hub.

16. The seal construction of claim 10 including at least one anti-picking tapered recess in the side of said at least one locking recess.

* * * * *